US009770822B2

(12) United States Patent
Sabbag et al.

(10) Patent No.: US 9,770,822 B2
(45) Date of Patent: Sep. 26, 2017

(54) TOOLBOX

(71) Applicant: THE STANLEY WORKS ISRAEL LTD., Rosh Ha'Ayin (IL)

(72) Inventors: Yosi Sabbag, Holon (IL); Danny Baruch, Lapid (IL); Michael Menirom, Raanana (IL)

(73) Assignee: THE STANLEY WORKS ISRAEL LTD (IL)

( * ) Notice: Subject to any disclaimer, the term of this patent is extended or adjusted under 35 U.S.C. 154(b) by 399 days.

(21) Appl. No.: 14/051,819

(22) Filed: Oct. 11, 2013

(65) Prior Publication Data

US 2014/0102928 A1 Apr. 17, 2014

(30) Foreign Application Priority Data

Oct. 17, 2012 (EP) ..... 12188873

(51) Int. Cl.
*B25H 3/02* (2006.01)

(52) U.S. Cl.
CPC ..... *B25H 3/028* (2013.01); *B25H 3/027* (2013.01)

(58) Field of Classification Search
CPC ..... B25H 3/028; B25H 3/027; B25H 3/023; B25H 3/02; B25H 3/021; A01K 97/06
USPC ..... 206/372, 373
See application file for complete search history.

(56) References Cited

U.S. PATENT DOCUMENTS 2,517,914 A * 8/1950 Nowaczek ..... A01K 97/06 312/269
2,591,726 A 4/1952 Schoen
3,377,736 A * 4/1968 Woolworth ..... A01K 97/06 43/57.1
3,410,018 A * 11/1968 Woolworth ..... A01K 97/06 206/315.11
3,606,511 A * 9/1971 Henning ..... A01K 97/06 206/315.11
3,985,409 A * 10/1976 Kneier ..... B25H 3/023 312/266
4,643,494 A 2/1987 Marleau
4,691,470 A * 9/1987 Landell ..... A01K 97/06 362/191

(Continued)

FOREIGN PATENT DOCUMENTS

DE 9200633 U1 3/1992

OTHER PUBLICATIONS

David Radu, European Search report, dated Nov. 23, 2012, The Hague.

(Continued)

*Primary Examiner* — Steven A. Reynolds
(74) *Attorney, Agent, or Firm* — Carl E. Myers

(57) ABSTRACT

The invention provides a container having a base and a lid, which together defines an internal compartment when the lid is in a closed position, and a tray located within the internal compartment. The tray is slidingly attached to the container by for example, a pair of slides, such that the tray is free to slide in at least one substantially lateral direction in relation to the container when the lid is in an open position. The lid may be a one-piece lid which is attached to the base by a hinge at one side of the base. The tray may be slidingly attached to the base and the tray is free to slide over the hinge side of the base when the lid is in an open position.

17 Claims, 8 Drawing Sheets

(56) References Cited

U.S. PATENT DOCUMENTS

| | | | | | |
|---|---|---|---|---|---|
| 5,176,281 | A * | 1/1993 | Fiore | A45C 7/0045 | 190/102 |
| 5,205,429 | A * | 4/1993 | Woolworth | B25H 3/028 | 190/33 |
| 5,244,265 | A * | 9/1993 | Chiang | B25H 3/023 | 312/107 |
| D358,708 | S * | 5/1995 | Ko | D3/275 | |
| 5,611,170 | A * | 3/1997 | McGuff | A01K 97/06 | 43/54.1 |
| 5,826,719 | A | 10/1998 | Chen | | |
| 6,267,484 | B1 * | 7/2001 | Baker | A01K 97/06 | 362/154 |
| 7,278,234 | B2 * | 10/2007 | Marino | A01K 97/22 | 206/315.11 |
| 7,681,731 | B1 | 3/2010 | Chern | | |
| D730,051 | S * | 5/2015 | Whalen | D3/284 | |
| 2004/0129595 | A1 * | 7/2004 | Dane | A61B 19/0264 | 206/503 |

OTHER PUBLICATIONS

Annex to the European Search Report on European Patent Application No. EP 12 18 8873, dated Nov. 16, 2012.

* cited by examiner

TOOLBOX

CROSS-REFERENCE TO RELATED APPLICATIONS

This application claims priority, under 35 U.S.C. §119, to European Patent Application No. 12188873.9, filed Oct. 17, 2012, titled "TOOLBOX".

FIELD OF THE INVENTION

The present invention relates to containers, and particularly to portable containers which may be used as toolboxes. It is known to provide toolboxes which have the internal space partitioned in various ways. A toolbox may be partitioned by providing one or more folding cantilevered trays within the toolbox, such that the cantilevers can be unfolded to move the tray or trays to allow access in and around them.

BACKGROUND OF THE INVENTION

The present invention provides a container having a base and a lid, the base and lid together defining an internal compartment when the lid is in a closed position, and a tray located within the internal compartment. The tray is slidingly attached to the container by attachment means, which may for example be a pair of slides, such that the tray is free to slide in at least one substantially lateral direction in relation to the container when the lid is in an open position.

BRIEF SUMMARY OF THE INVENTION

The lid may be a one-piece lid which is attached to the base by a hinge at one side of the base. The tray may be slidingly attached to the base of the container and may be free to slide in one or more lateral directions. For example, it may be free to slide in only one lateral direction, over the hinge side of the base when the lid is in an open position. The lid may have a rim formation configured to support part of the base of the tray when the lid is opened and the tray is extended over the hinge side of the base.

The container may include a second tray also located within the internal compartment when the lid is in a closed position, the second tray being slidingly attached to the first tray by attachment means such as a second pair of slides. There may be additional further trays, each slidingly attached, and the trays may form a stack. The trays may each have substantially the same length and width.

The compartmentalization of a toolbox using one or more slidable trays allows the user to keep tools and parts organized during transport and use of the toolbox. The independent slidability of each tray means that items which are needed most frequently can be kept in the upper tray of the tray stack, so that they can be accessed by simply opening the hinged lid without the need to slide any trays. Items needed less frequently can be kept in a different tray of the tray stack, if any, or in the main compartment of the container, and these items can be accessed when required by opening the hinged lid and extending one or more trays along its slides to open or close the space beneath it. This provides more convenience for the user than a conventional cantilever tray system, in which all the trays must be extended or closed at the same time.

Each tray may itself be partitionable, for example, by being adapted for insertion of partitions spanning the tray. A tray may be partitioned into a plurality of sub-compartments by the insertion of one or more linear partitions or one or more individual pots.

Any or all of the slides may be friction slides. However, alternative types of slides may be used, for example, ball-bearing type slides. One or more of the pairs of slides may be fully extendible in at least one of the directions in which the tray can slide. If the slides of a tray permit it to be moved away from the tray's home position in two opposite directions, then the toolbox provides very adaptable storage compartments wherein each compartment underneath a tray can be accessed by sliding the tray in either direction. Alternatively, if the tray is free to slide away from its home position in only one lateral direction, this means that the compartment underneath that tray can only be accessed when the tray slides in that direction but the stability of the toolbox is improved. For example, by restricting the slidability of the tray or trays such that they can only slide over the hinge side of the base, then the shape and sizes of the base, lid and trays can be arranged to be such that the toolbox is stable and supported in all tray configurations. Alternatively, the tray or trays may be able to slide only over a non-hinge side of the base, and an additional support may be provided to support the tray or trays when they are in the extended position.

Slides providing full extension allow complete access to the toolbox compartments, including the trays, however simpler, less expensive slides which allow less than full extension could be used for some or all of the slides. One or more of the pairs of slides may have stopping means to prevent the corresponding tray being detached from the part of the container or from the tray to which it is slidingly attached. The slides may be made of plastic, metal, or any other suitable material.

One or more of the trays may be shaped such that when the lid is closed, one or more portions of the tray are close to portions of the inside surface of the lid such that the tray is substantially not free to slide. This can help to retain tools and parts in the tray or toolbox compartment where the user has placed them before closing the lid.

The toolbox lid may comprise a support such that when the lid is in an open position the support engages a flat surface, such as an area of the ground, on which a bottom surface of the base rests. Such an arrangement provides extra stability when the tray or trays are extended over the hinge side of the base, compared to a toolbox with no such lid support. This support may be provided by the base, lid and hinge being arranged such that the main top surface of the lid touches the ground when the lid is fully opened. Alternative means of support include providing one or more support legs which protrude from or fold out from the main face of the lid in order to engage with the surface on which the base rests.

The tray and the components of the toolbox such as the lid and base, may have guiding structures, such as elongated ribs, in order to guide the trays in the correct sliding relationship to the lid or base. For example, a tray may have ribs on the external bottom face, which extend in the direction of sliding, and which interact with the rim shape of the base or lid to ensure that the tray cannot become misaligned with the toolbox during sliding or use.

The toolbox may be portable. A toolbox according to the invention may have a carrying handle attached to the top of the lid and/or may include wheels fixed to the base to enable rolling transport. The toolbox may also comprise additional or alternative handles at other positions on the external surface, to enable handling and movement of the toolbox in a range of ways.

This arrangement of trays and slides is robust, particularly compared to cantilevered tray systems which can suffer from drawbacks such as breakage of the cantilever arms, breakage of the cantilever arm pivots, or misalignment of the cantilever arm system. The trays of the present invention are compact and strong compared to a cantilever arm tray system. During extension and retraction of any part of the tray system, the trays stay in the same vertical supported relationship to each other, and the forces applied to the support system are therefore more uniform than in a cantilever tray system, in which the trays have a vertical component as well as a horizontal component to their movement, as they are swung up on their cantilever pivots when the cantilevers are extended. It is therefore possible to carry heavier items in a sliding tray arrangement according to the invention, than in a comparable cantilever tray arrangement.

As long as the container is placed on a relatively level surface, wherever the trays are positioned, they have no tendency to move to any other position.

BRIEF DESCRIPTION OF THE DRAWINGS

The invention is herein described, by way of example only, with reference to the accompanying drawings, wherein.

DETAILED DESCRIPTION OF THE INVENTION

Figure 1:
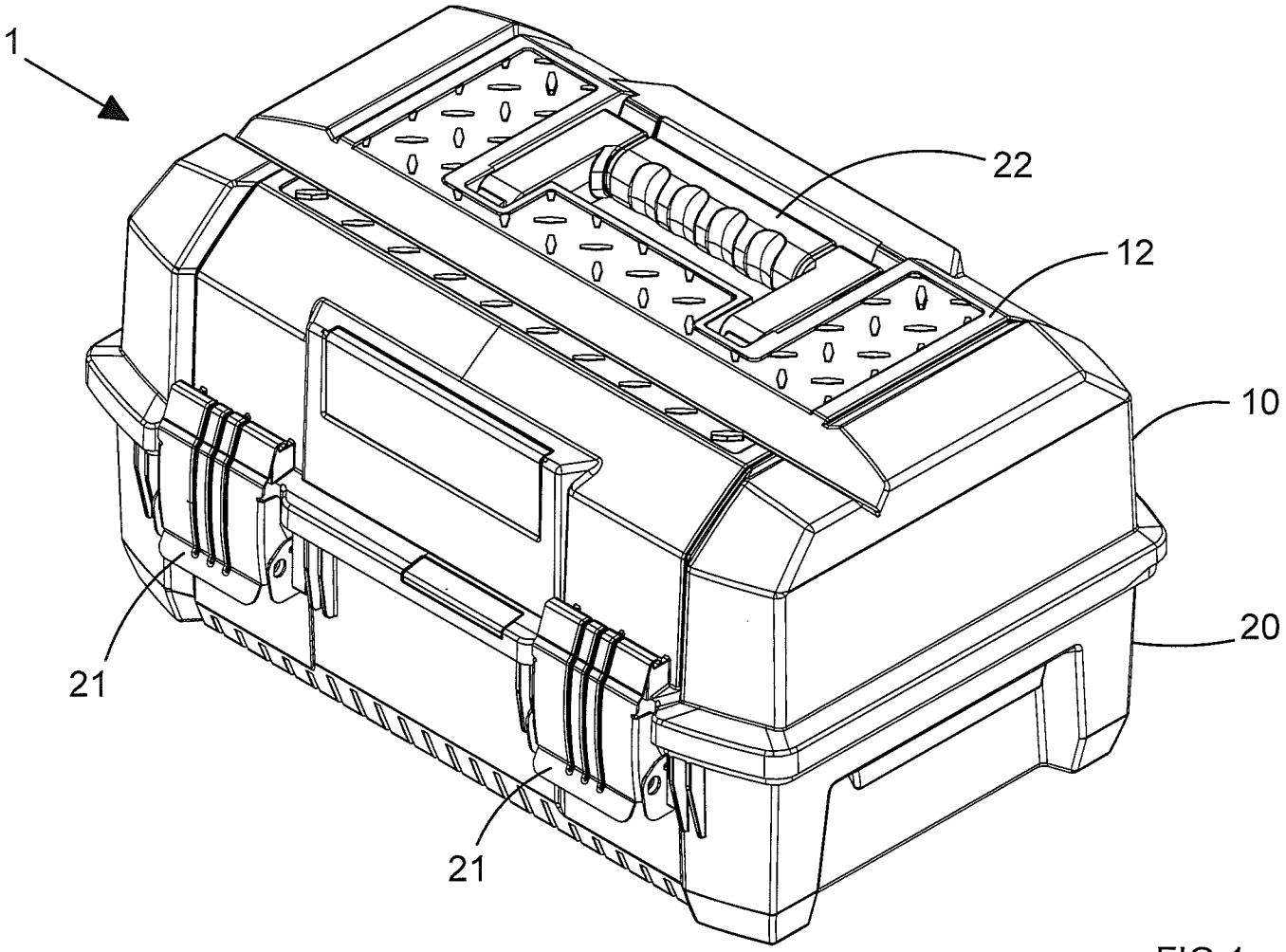
FIG. 1 is a view of a toolbox according to the invention, with the lid closed.

FIG. 1 shows a view of a toolbox 1 according to the invention, with the lid closed. The lid 10 and base 20 of the toolbox meet to define an internal compartment inside the toolbox. The lid can be held in the closed position by two latches 21. Alternatively, one latch, or more than two latches can be provided to hold the lid closed, as required. The lid 10 is connected to the base 20 by a hinge (not shown). A seal 5 is provided along the meeting line of the lid 10 and base 20, in order to seal the toolbox. Such seals may be waterproof or splashproof, for example. The toolbox is portable and has a carrying handle 22 attached to the top of the lid.

Figure 2:
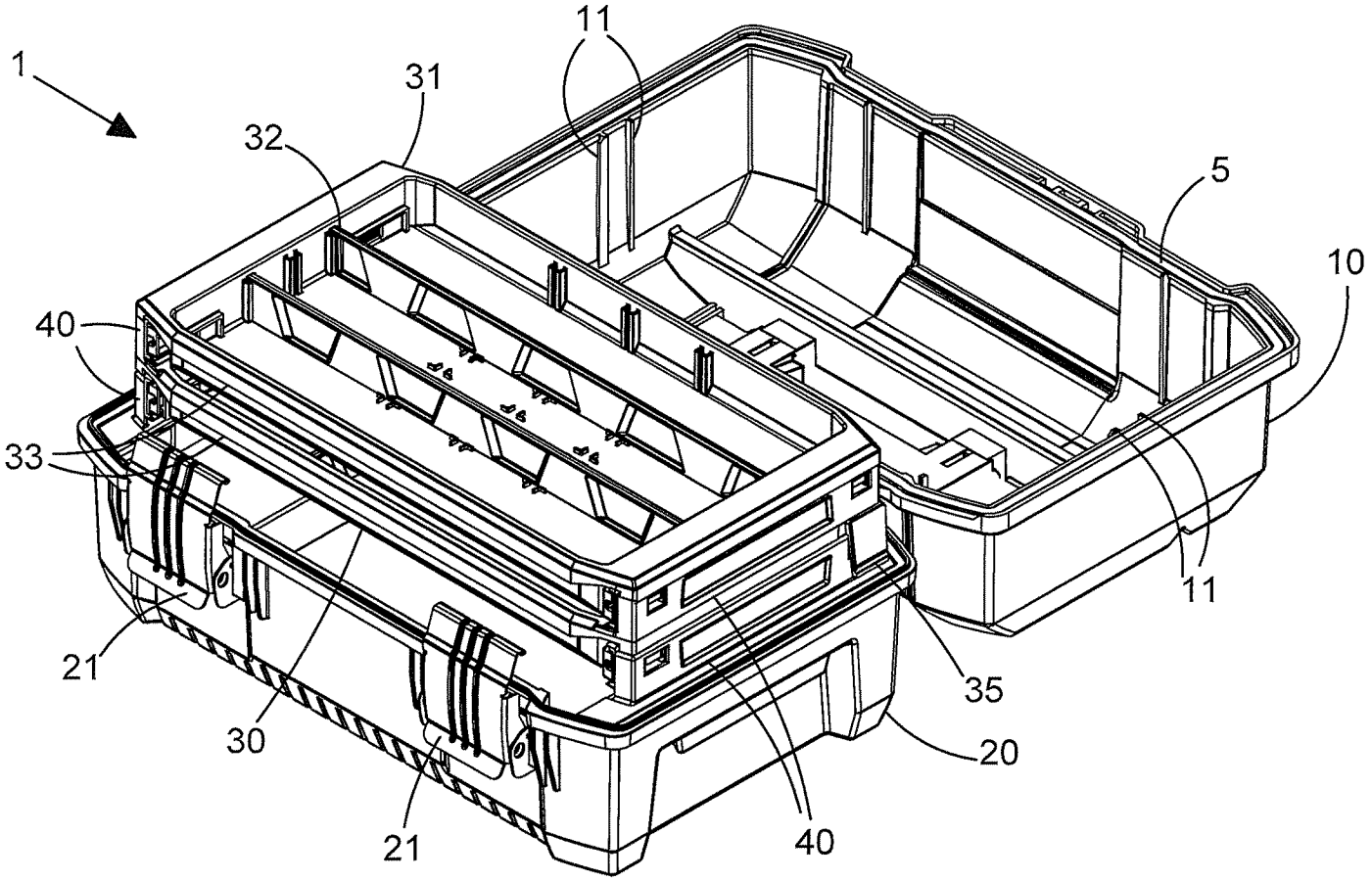
FIG. 2 is a view of the toolbox of FIG. 1, with the lid open.

The toolbox lid can be opened as shown in FIG. 2, in which the lid 10 is fully opened by 180°. In this embodiment, when the lid is fully opened, the main outer face 12 of the lid acts as a lid support by engaging and resting upon a flat surface on which the base rests, so that the lid is supported in the fully open position. When it is open the lid 10 can be used as a temporary storage space, for example, for tools, screws or other items of hardware which are being worked with.

Figure 3:
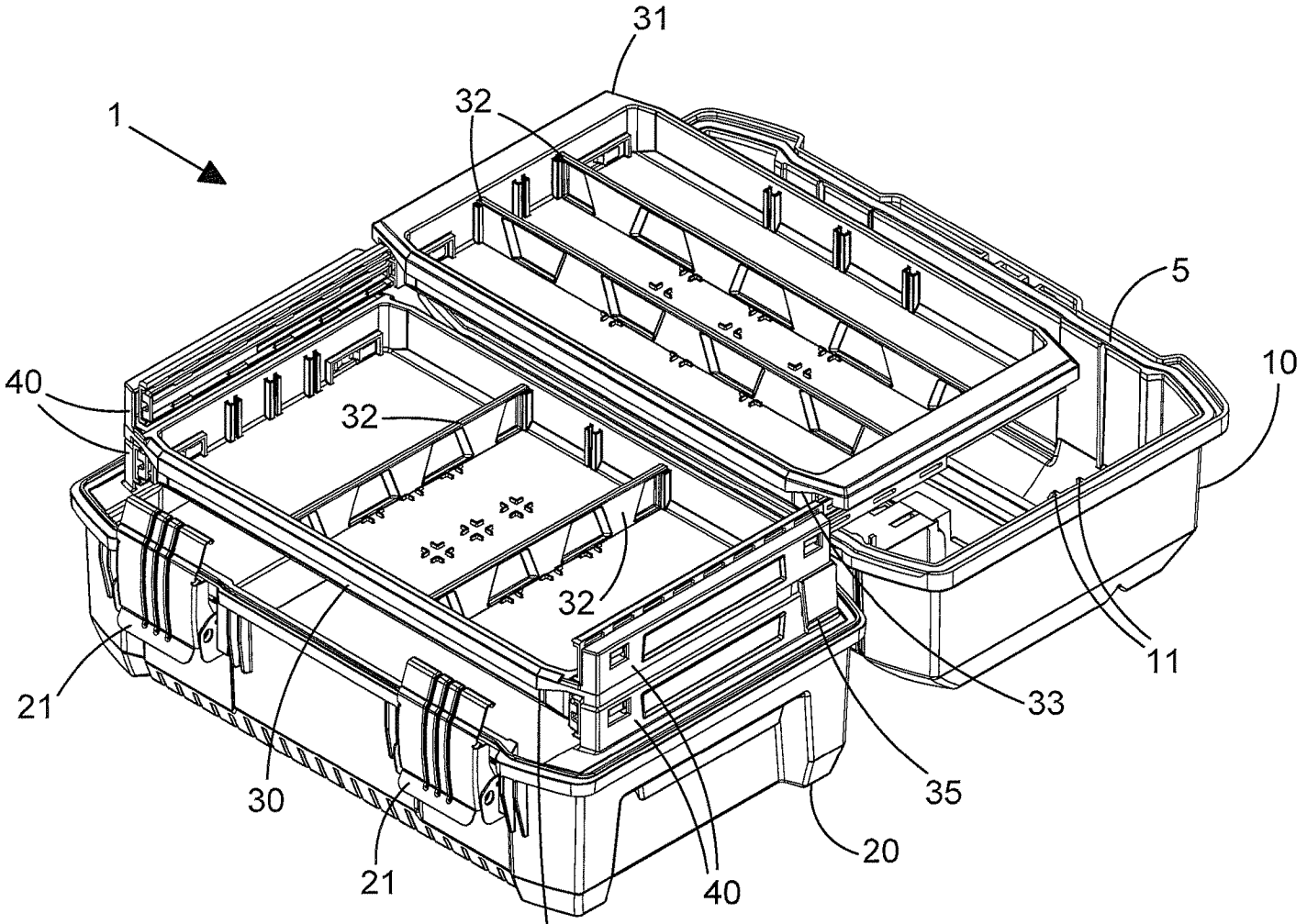
FIG. 3 is a view of the toolbox of FIG. 2, with the top tray of the stack of two trays extended.
Figure 4:
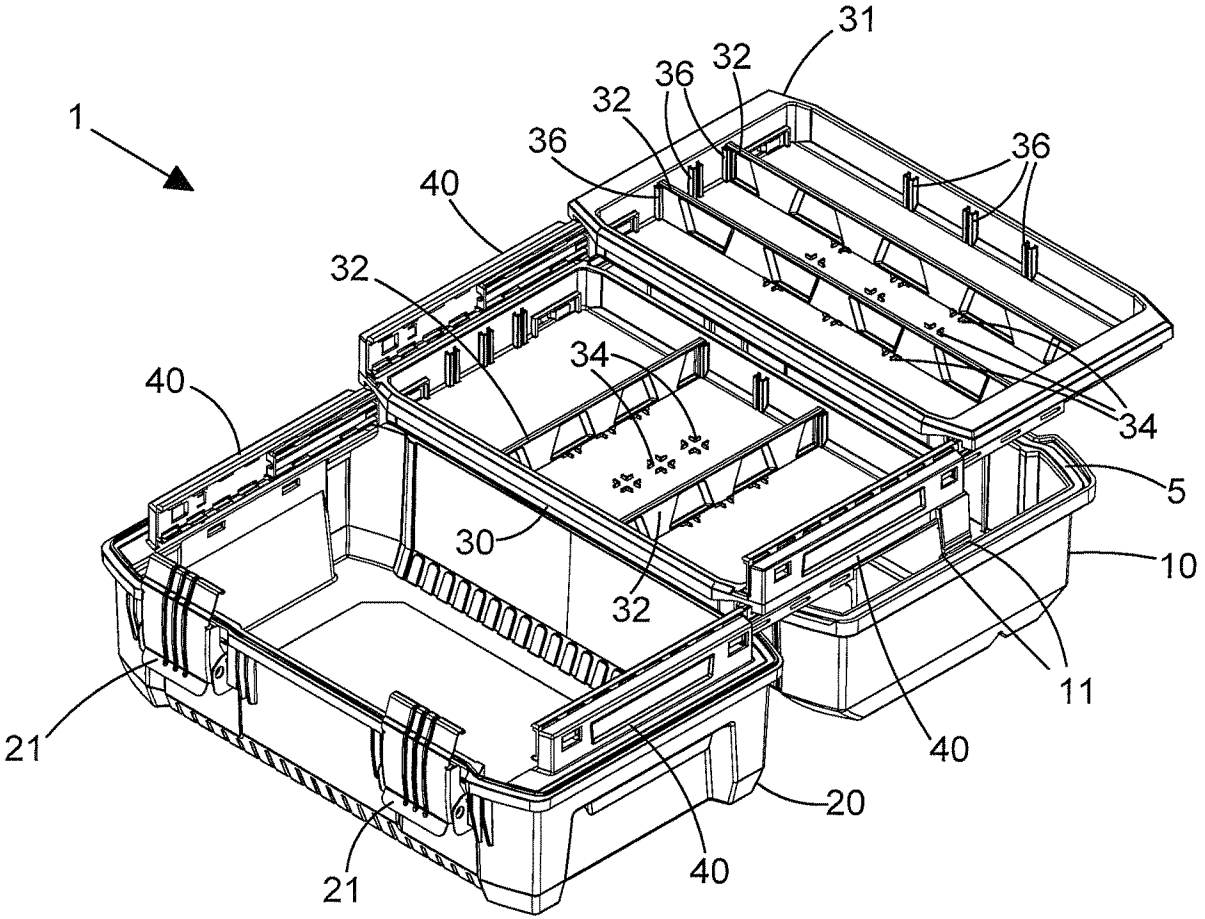
FIG. 4 is a view of the toolbox of FIG. 2, with both trays of the stack of two trays extended.
Figure 5:
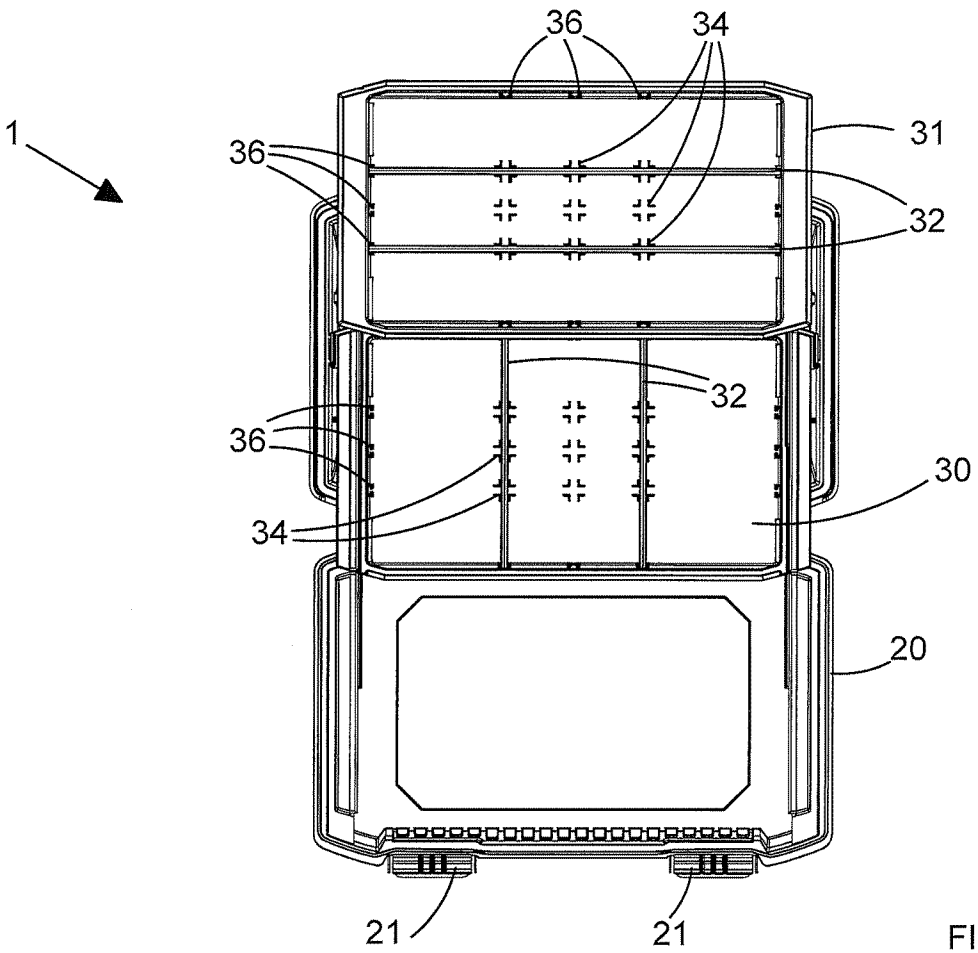
FIG. 5 is a top view of the toolbox of FIG. 4.

The toolbox shown in the Figures includes two trays 30, 31, which are positioned in a stack. The trays both include profiled front lips 33, which the user can grip to easily slide each tray. The lower tray 30 is connected to the toolbox base by a pair of slides 40, and the upper tray 31 is connected to the lower tray by an identical pair of slides 40. Alternative embodiments may be arranged in a similar way to the toolbox shown in the Figures, but may include only one tray, or more than two trays. As shown in FIGS. 3 and 4, the trays can be individually extended by sliding them along their slides. As shown most clearly in FIGS. 4 and 5, each tray of the toolbox has a number of side grooves 36 and spaced protrusions 34 on the bottom, in which removable linear partitions 32 can be positioned.

Figure 6:
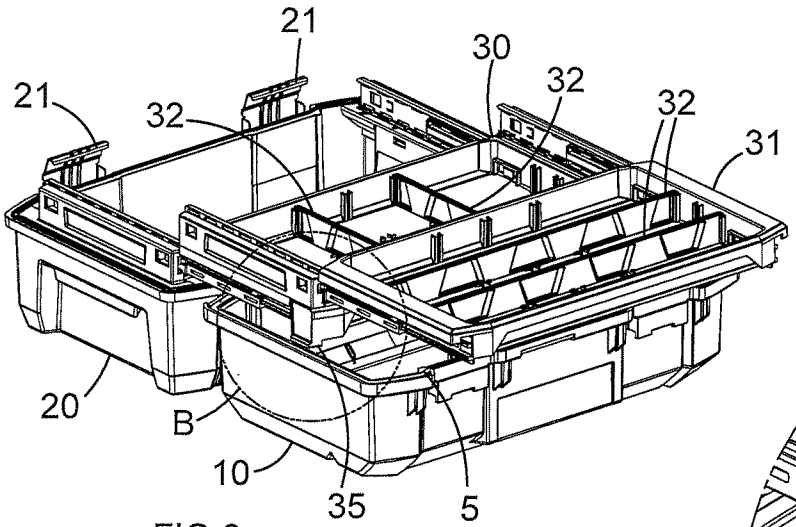
FIG. 6 is a different perspective view of the toolbox of FIG. 4.
Figure 7:
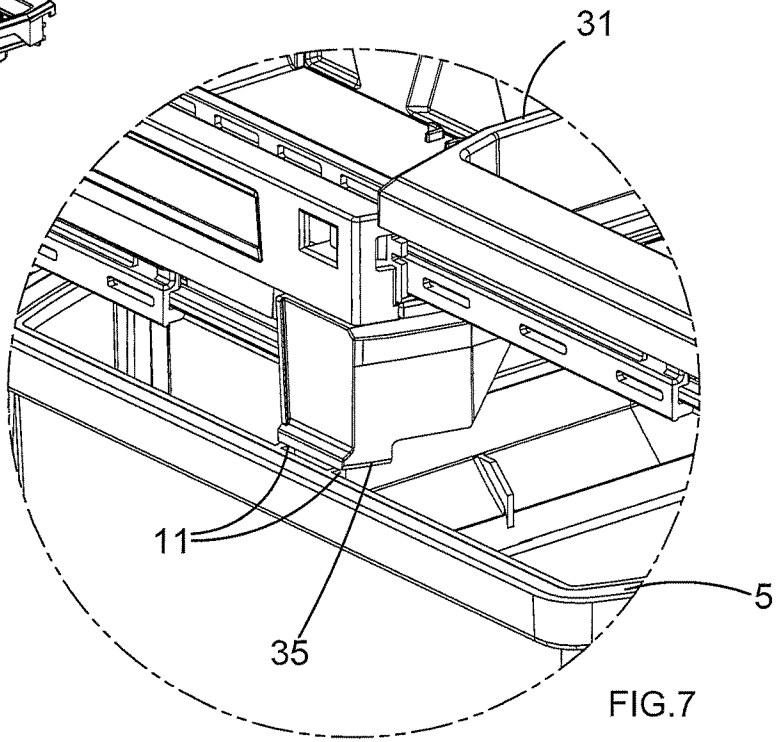
FIG. 7 is a close up of the area indicated 'B' in FIG. 6.

Referring to FIGS. 6 and 7 in particular, the lower tray 30 has a support leg 35 on both sides, which can be supported on ribs 11 of the lid when the tray is fully extended. Alternatively, the tray may have one or more legs at one side, or at other positions on its base, which can be supported by other parts of the lid. Any such support of the extended lower tray by the lid helps to support and stabilise the extended tray assembly. Such an arrangement also ensures that the lid 10 cannot be closed or moved while the lower tray 30 is extended, essentially locking the lid hinge in the open position.

The trays of the embodiment shown in FIGS. 1 to 7 are shaped such that when the lid is closed, the edges of the trays are close to part of the inside surface of the toolbox, such that the trays are substantially prevented from sliding along the slides when the lid is closed.

Figure 8A:
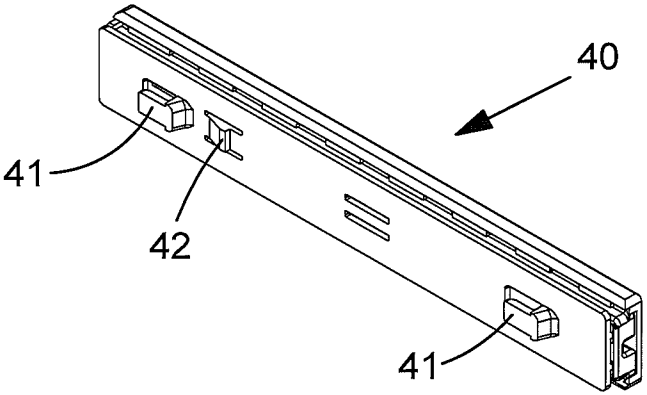
FIG. 8A is a view of a slide which can be fitted to a toolbox according to the invention, showing a closed configuration.
Figure 8B:
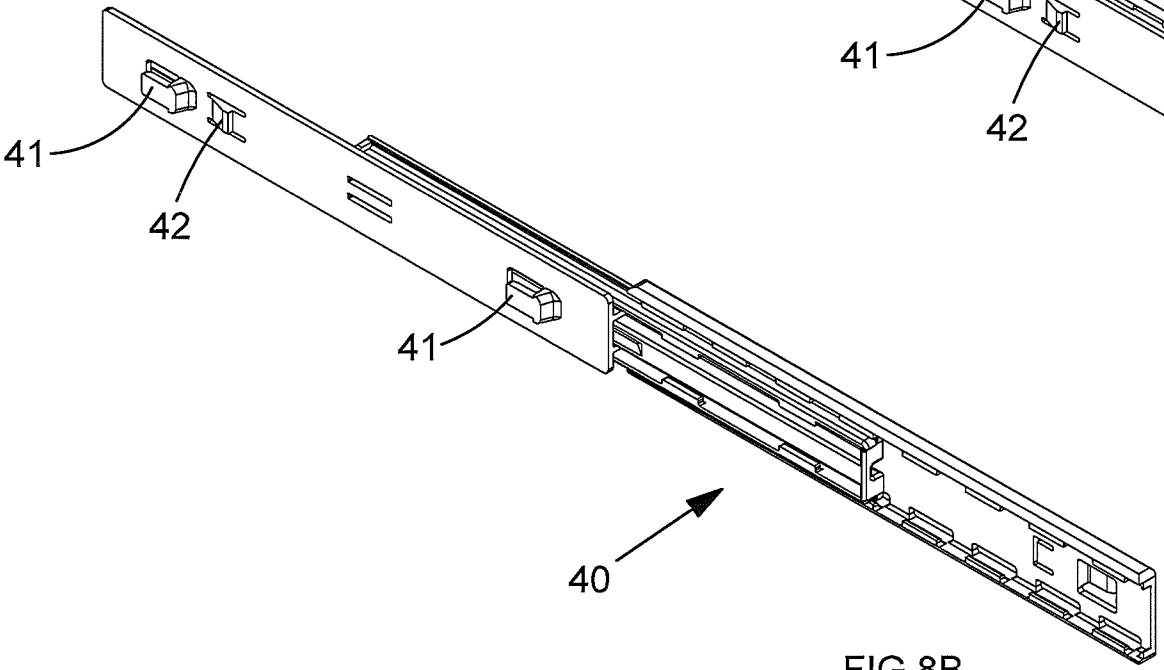
FIG. 8B is a view of a slide which can be fitted to a toolbox according to the invention, showing an open configuration.

The slides 40 of the toolbox shown in FIG. 1 are three-part friction slides, which allow 100% extension. As shown clearly in FIG. 5, the trays can be fully extended. When each tray is fully extended the whole of the tray below, and the whole of the main storage area in the base, is directly accessible from above. FIG. 8*a* shows a slide in a closed position, and FIG. 8*b* shows a slide in a fully extended position. The pair of slides may comprise a stopper at one end, such that when the tray is in the home position, it can slide in one direction but not the opposite direction. The pair of slides may also have an extension stopper to prevent the tray being removed from the slides by sliding it too far away from the home position.

Figure 9:
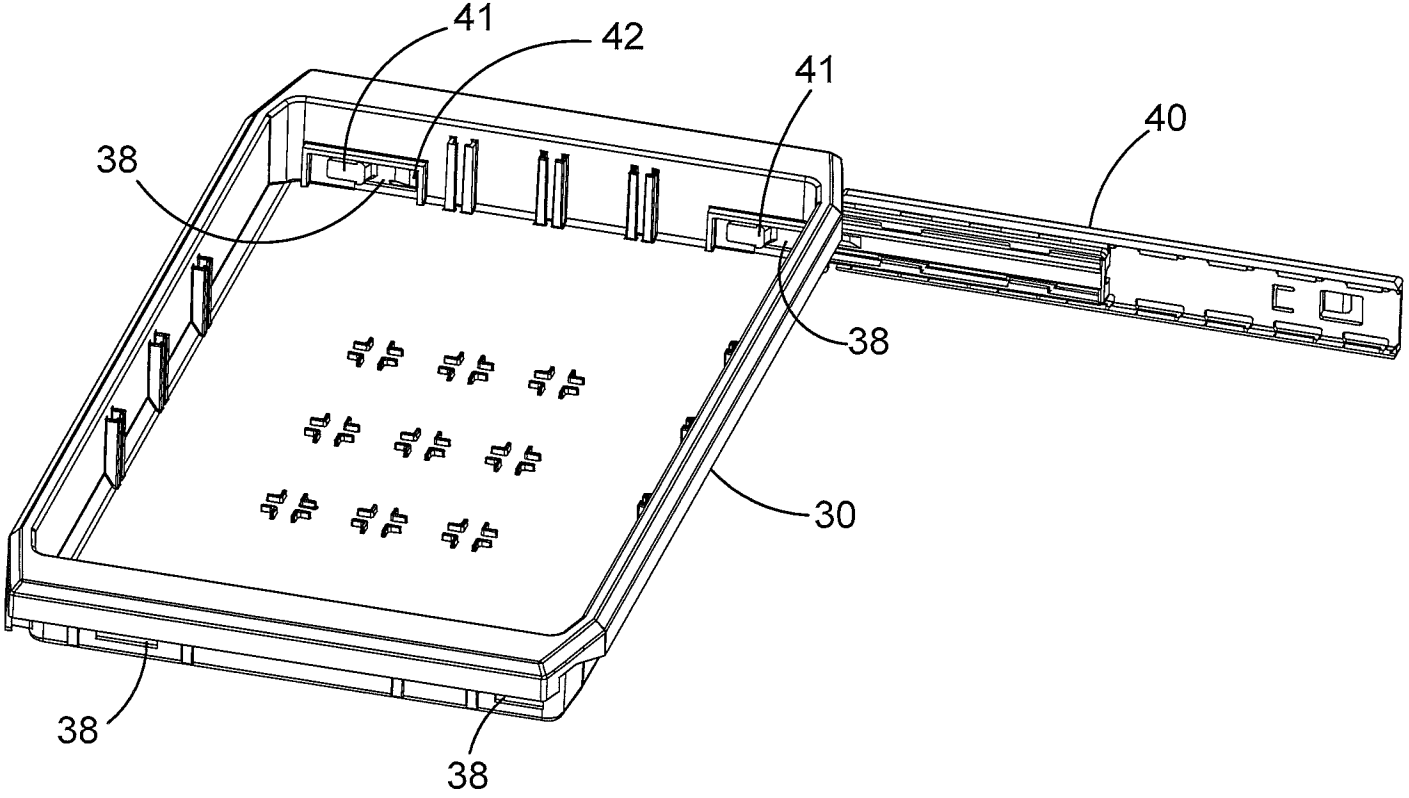
FIG. 9 is a view of one tray with one slide fitted to it.

FIG. 9 shows a tray 30 with one slide fitted to it, the slide being shown in an extended position. The slide is fixed to the tray by two hooks 41 which are each placed into a slot 38 of the tray. The slide also has a snap lock 42 which clicks into position in one of the slots when the slide is in the fixing position, in order to fix the slide onto the tray. Alternatively, the slides may be fixed to the tray using reversible fixing means, such as screws and screw holes, in order to allow the user to remove or add trays to the assembly when desired.

The components of the toolbox may be made from any suitable material, for example, plastic, wood or metal. Components made of plastic may be made using structural foam molding methods. The latch or latches may be made of metal, plastic, or any other suitable material.

It should be understood that although the invention has been described in conjunction with specific embodiments thereof, it is evident that many alternatives, modifications and variations will be apparent to those skilled in the art.

Accordingly, it is intended to embrace all such alternatives, modifications and variations that fall within the scope of the claims.

The invention claimed is:

1. A container comprising a base and a lid, the base and lid together defining an internal compartment when the lid is in a closed position;

the container further comprising a tray located within the internal compartment when the lid is in a closed position;

the lid further comprising a rim formation;

wherein the tray is slidingly attached to the container by a pair of slides, wherein the tray is free to slide in at least one substantially lateral direction in relation to the container when the lid is in an open position;

wherein the lid is attached to the base by a hinge at one side of the base;

wherein the tray is free to slide over the hinge when the lid is in an open position; and wherein when the lid is opened, and the tray is extended over the hinge, the tray is supported on the rim formation by one or more of ribs and legs that slide on the rim formation.

2. A container according to claim 1, wherein the lid is a one-piece lid.

3. A container according to claim 1, wherein the tray is a first tray and the pair of slides is a first pair of slides, the container further comprising a second tray located within the internal compartment when the lid is in a closed position, wherein the second tray is slidingly attached to the first tray by a second pair of slides.

4. A container according to claim 1, the container comprising one or more further trays, wherein each further tray is slidingly attached to the preceding tray by a further pair of slides.

5. A container according to claim 4, wherein the trays form a stack.

6. A container according to claim 4, wherein each tray has substantially the same length and width.

7. A container according to claim 4, wherein one or more of the one or more pairs of slides is a friction slide.

8. A container according to claim 4, wherein one or more of the one or more pairs of slides is fully extendible in one direction.

9. A container according to claim 4, wherein at least one of the one or more pairs of slides has a stopper to prevent the corresponding tray being detached from the part of the container or from the tray to which it is slidingly attached.

10. A container according to claim 4, wherein one or more of the one or more trays are shaped such that when the lid is closed, one or more portions of the tray are close to portions of the inside surface of the lid such that the tray is substantially not free to slide.

11. A container according to claim 1, wherein the lid comprises a support that engages a surface on which a bottom surface of the base rests when the lid is in an open position.

12. A container according to claim 11, wherein the support comprises at least part of the main outer face of the lid.

13. A container according to claim 1, wherein when the lid is in a fully open position, a main outer face of the lid acts as a lid support by engaging and resting upon a flat surface on which the base rests, so that the lid is supported in the fully open position.

14. A container comprising a base and a lid, the base and lid together defining an internal compartment when the lid is in a closed position;

the container further comprising a first tray located within the internal compartment when the lid is in a closed position, the first tray is slidingly attached to the container by a pair of slides, one or more further trays, wherein each further tray is slidingly attached to the preceding tray by a further pair of slides;

wherein the first tray is free to slide in at least one substantially lateral direction in relation to the container when the lid is in an open position;

wherein the lid has a rim formation configured to support part of the first tray when the lid is opened and the first tray is extended over a hinge side of the base;

wherein the trays form a stack;

wherein the first tray has a support that slides onto the rim formation when the first tray is slid into an extended position.

15. A container according to claim 14, wherein the first tray has supports at one or more of a side or a part of the first tray.

16. The container according to claim 15, wherein supports are located on opposing sides of the first tray, and wherein the rim formation is located on opposing sides of the lid.

17. The container according to claim 14, wherein the support comprises one or more of a leg and a rib.

* * * * *